US006602105B1

(12) United States Patent
Sussell

(10) Patent No.: US 6,602,105 B1
(45) Date of Patent: Aug. 5, 2003

(54) ILLUMINATION SYSTEM FOR BALLOONS WITH THIN FILM VALVES

(76) Inventor: Michael Sussell, 321 Greenwich St., New York, NY (US) 10013

( * ) Notice: Subject to any disclaimer, the term of this patent is extended or adjusted under 35 U.S.C. 154(b) by 0 days.

(21) Appl. No.: 09/176,402

(22) Filed: Oct. 21, 1998

(51) Int. Cl.[7] ..... F21V 33/00; A63H 3/06
(52) U.S. Cl. ..... 446/220; 362/253
(58) Field of Search ..... 362/253, 267, 362/806, 807, 96; 446/220, 224

(56) References Cited

U.S. PATENT DOCUMENTS

| | | | | | |
|---|---|---|---|---|---|
| 4,542,445 | A | * | 9/1985 | Marletta | 362/96 |
| 4,917,646 | A | | 4/1990 | Kieves | 446/224 |
| 5,075,830 | A | | 12/1991 | Perez | 362/352 |
| 5,117,344 | A | * | 5/1992 | Perez | 362/352 |
| 5,119,281 | A | * | 6/1992 | Akman | 362/253 |
| 5,378,299 | A | | 1/1995 | McGrath | 156/290 |
| 5,399,122 | A | | 3/1995 | Slater | 472/51 |
| 5,795,211 | A | | 8/1998 | Carignan | 446/220 |
| 5,807,157 | A | * | 9/1998 | Penjuke | 446/220 |
| 5,959,521 | A | | 9/1999 | Becker | 446/224 |

* cited by examiner

*Primary Examiner*—Cassandra Spyrou
*Assistant Examiner*—Jared Treas
(74) *Attorney, Agent, or Firm*—Goldstein & Canino

(57) ABSTRACT

A balloon illumination system, for illuminating a thin film balloon comprising a pair of thin film panels that are heat sealed together to define a balloon interior, the balloon having a balloon top and a balloon bottom, an apex at the balloon top, a mouth at the balloon bottom, and a flat film valve creating a sleeve having a sleeve width. The balloon illumination system comprises a tube having a tube circumference that is substantially equal to two times the sleeve width, a proximal end and a distal end. A light source is located in the tube midway between the proximal end and distal end. An electrical cable extends proximal through the tube from the light source. The distal end of the tube is inserted into the mouth of the tube and is extended through the sleeve until the distal end reaches the apex. Leakage is prevented by the tight fit between the tube and the sleeve. The light source is positioned in the balloon interior midway between the balloon top and balloon bottom. The light source is illuminated by connecting the electrical cable to a power source. By a further embodiment, the tube has an accordion portion having a plurality of transverse folds. The accordion portion is compressed while within the sleeve to pinch the sleeve therein and further prevent gases from leaving the balloon interior.

5 Claims, 4 Drawing Sheets

ILLUMINATION SYSTEM FOR BALLOONS WITH THIN FILM VALVES

BACKGROUND OF THE INVENTION

The invention relates to a balloon illumination system. More particularly, the invention relates to a system for providing internal illumination in non-stretching balloons having a double-ply thin film valve.

Traditional balloons were made of latex rubber, or another similar elastic substance. These balloons have a neck, through which high pressure gas is introduced. With the introduction of the gas, the balloon stretches and expands until the difference in pressure between the inside and outside of the balloon balances the elastic tendency of the balloon to return to its unstretched form.

In recent decades, non-stretching balloons made of a thin film, such as MYLAR, have overtaken the traditional latex balloon for many applications. Because the MYLAR balloon is made of inelastic material, new valves were devised to allow gases to be introduced into the balloon, while preventing the escape of said gases thereafter.

One extremely popular valve for thin film balloons is a self sealing valve which comprises two thin flexible sheets that are bonded together along two edges, and extend between the balloon interior and balloon exterior. When pressurized gas is introduced into the valve, the sheets flex apart, creating a passageway for gas to flow into the balloon. However, once the gas source is removed from the valve, the sheets flatten against each other, sealing the valve and preventing gas inside the balloon from escaping. U.S. Pat. No. 5,595,521 to Becker; U.S. Pat. No. 4,917,646 to Kieves; and U.S. Pat. No. 5,378,299 to McGrath et al. are illustrative of the flat film valve, and describe flat film valve manufacturing technology.

Most of the attempts to illuminate balloons have been directed at latex balloons. Since thin film MYLAR balloons are only a recent development, there have been relatively few attempts to devise an effective illuminating assembly for these balloons. There have been no attempts which take specific advantage of the flat film self sealing valve.

U.S. Pat. No. 5,795,211 to Carignan et al. discloses an illuminated non-latex balloon, in which flat metal electrical conductors are heat sealed between the balloon panels during the manufacturing of the balloon itself. Although in one embodiment shown a flat film valve is present in the balloon, the conductors do not extend through the valve, but extend either alongside the valve or are fused outside one of the panels of the valve.

Other examples of illuminated balloon assemblies are shown in U.S. Pat. No. 5,075,830 and U.S. Pat. No. 5,117,344 to Perez; U.S. Pat. No. 4,787,575 to Stewart; U.S. Pat. No. 4,542,445 to Marletta; U.S. Pat. No. 5,782,668 to Chabert; and U.S. Pat. No. 4,794,898 to Neumeier.

While these units may be suitable for the particular purpose employed, or for general use, they would not be as suitable for the purposes of the present invention as disclosed hereafter.

SUMMARY OF THE INVENTION

It is an object of the invention to produce an illuminated balloon device which may be inserted through a self-sealing flat film valve to position a light source within the balloon. Accordingly, a tube is inserted through the valve, the tube having the light source located therein.

It is a further object of the invention to produce an illuminated balloon device that prevents air from escaping through the valve, even while the tube is located therein. Accordingly, the diameter of the tube is selected so that it's circumference is substantially equal to two times the width of the valve.

It is a still further object of the invention to provide a balloon which is evenly illuminated. Accordingly, the light source is positioned along the tube such that once the tube is fully inserted into the balloon such that the tube has reached the apex of the balloon, the light source is positioned substantially midway between the valve and the balloon top.

It is yet a further object of the invention to accomplish superior sealing between the valve and the tube. Accordingly, an accordion portion is provided on the tube at a location which will remain in the valve when the tube is fully inserted into the balloon. Following insertion of the tube, the accordion portion is compressed to interfold the valve with the accordion portion, thus achieving a tight seal therebetween.

The invention is a balloon illumination system, for illuminating a thin film balloon comprising a pair of thin film panels that are heat sealed together to define a balloon interior, the balloon having a balloon top and a balloon bottom, an apex at the balloon top, a mouth at the balloon bottom, and a flat film valve creating a sleeve having a sleeve width. The balloon illumination system comprises a tube having a tube circumference that is substantially equal to two times the sleeve width, a proximal end and a distal end. A light source is located in the tube midway between the proximal end and distal end. An electrical cable extends proximal through the tube from the light source. The distal end of the tube is inserted into the mouth of the tube and is extended through the sleeve until the distal end reaches the apex. Leakage is prevented by the tight fit between the tube and the sleeve. The light source is positioned in the balloon interior midway between the balloon top and balloon bottom. The light source is illuminated by connecting the electrical cable to a power source. By a further embodiment, the tube has an accordion portion having a plurality of transverse folds. The accordion portion is compressed while within the sleeve to pinch the sleeve therein and further prevent gases from leaving the balloon interior.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
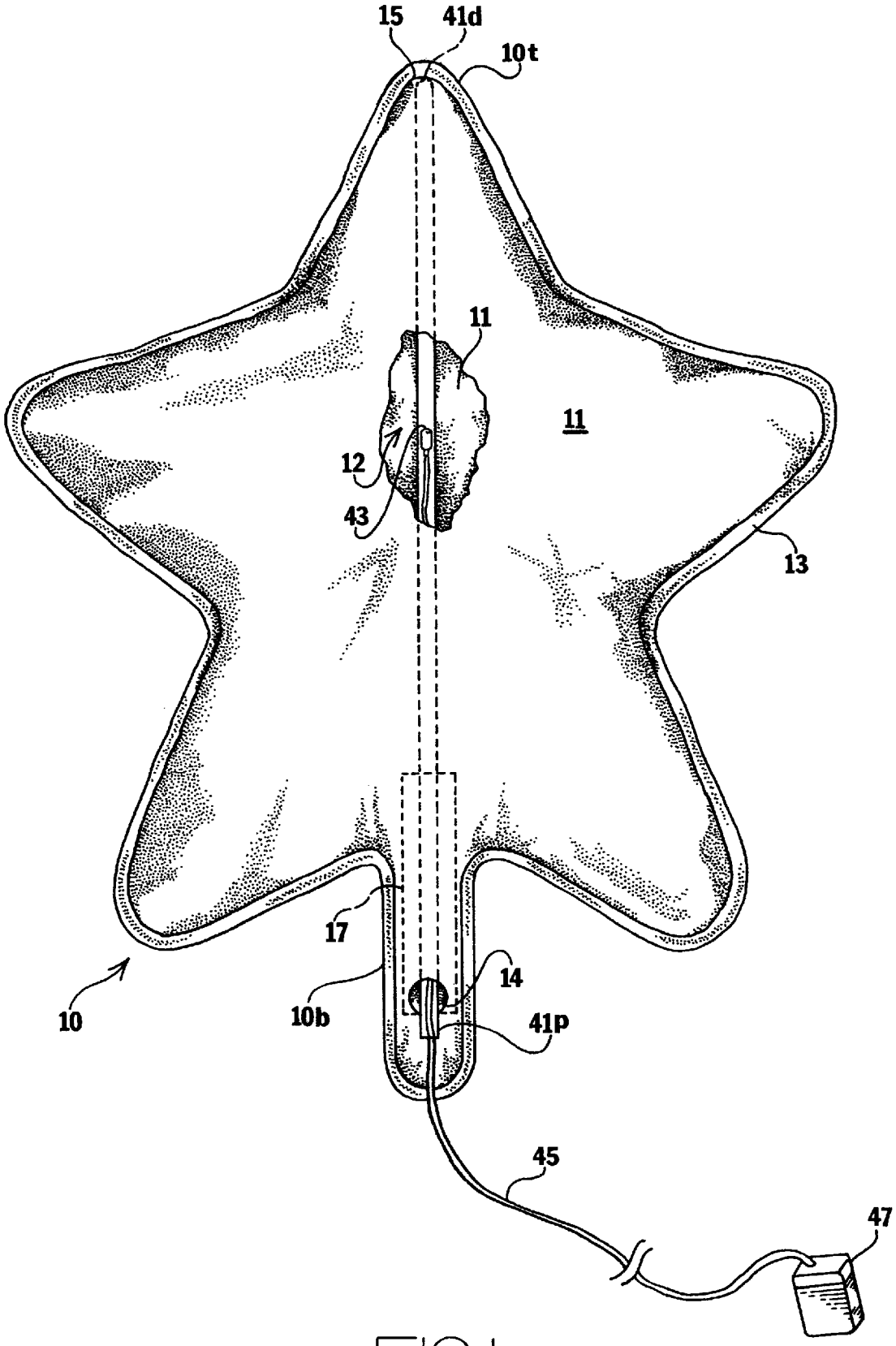
FIG. 1 is a front elevational view a thin film balloon having a flat film valve, wherein the tube of the illuminating device is inserted therethrough, and wherein a portion of the balloon has been cut away to show the light source in the tube.

FIG. 1 illustrates a balloon 10, having a balloon top 10T and a balloon bottom 10B. The balloon 10 comprises a pair of thin film panels 11, each made of thin plastic material such as MYLAR, which are heat sealed along an outer perimeter 13 to define a balloon interior 12. A mouth 14 is an opening present in one of the thin film panels 11 near the balloon bottom 10B. An apex 15 is a point near the balloon top 10 which is fully opposite the mouth 14. The balloon 10 is illustrated in a star-shaped configuration. However, the balloon can be provided in any of a wide variety of shapes and sizes.

A flat film valve 17 is located near the balloon bottom 10B, such that said flat film valve 17 is in direct communication with the mouth 14. In fact, any gaseous communication between the mouth 14 and the balloon interior 12 must occur by means of the valve 17. The valve 17 extends vertically within the balloon interior 12 in the direction of the balloon apex 15.

Figure 4:
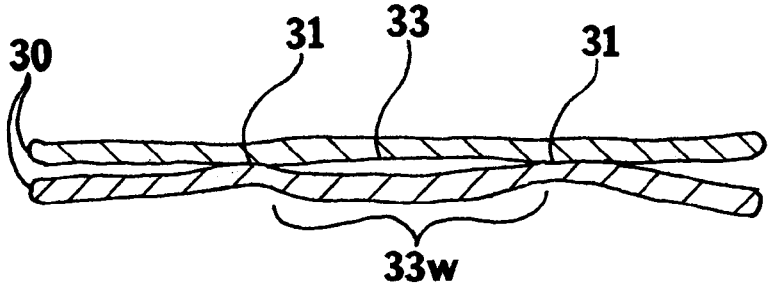
FIG. 4 is a cross sectional view, taken in the direction of line 4—4 in FIG. 2, illustrating the flat film valve without the tube inserted therethrough.

Referring momentarily to FIG. 4, the flat film valve 17 comprises two flat valve panels 30 which are fused together along a pair of parallel fused strips 31 to create a sleeve 33. The flat valve panels 30 normally rest against each other, minimizing if not completely closing off the sleeve 33. The sleeve 33 has a sleeve width 33W which is defined as a distance between the fused strips 31.

Figure 2:
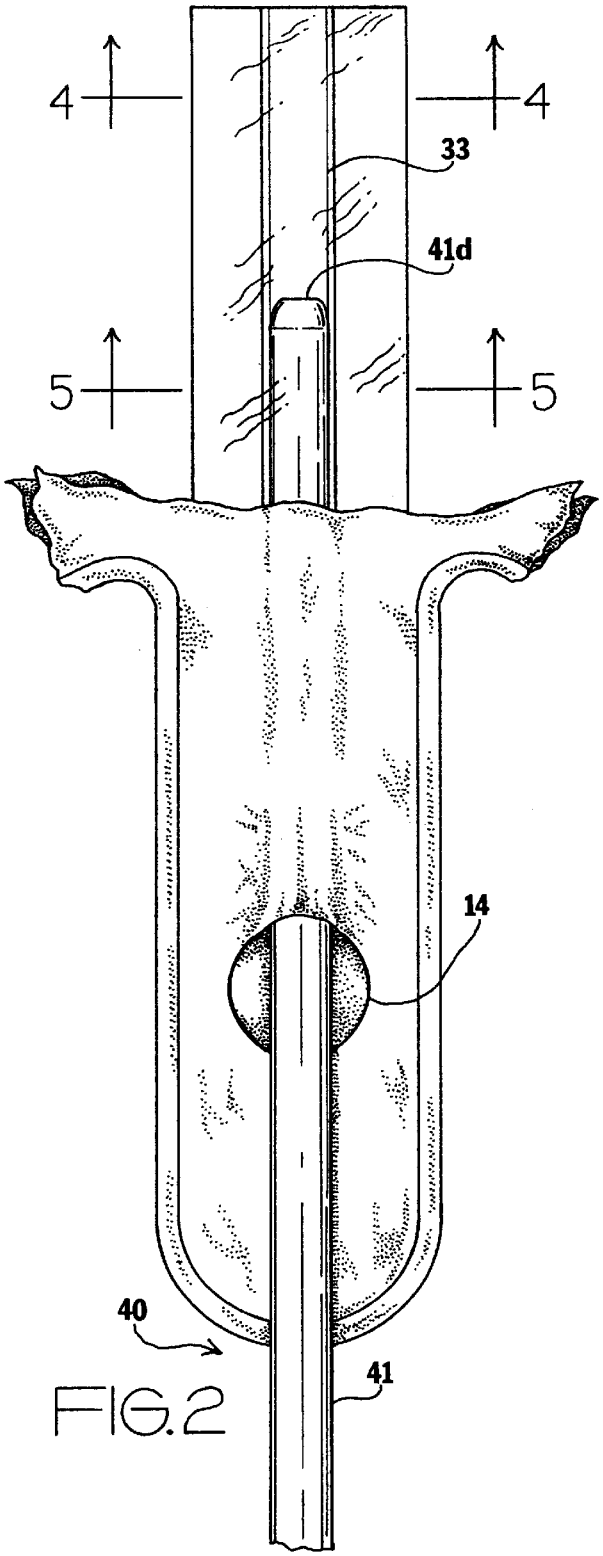
FIG. 2 is a front elevational view with parts broken away, illustrating a lower portion of the balloon wherein the flat film valve is located, showing the tube being inserted through the flat film valve.
Figure 5:
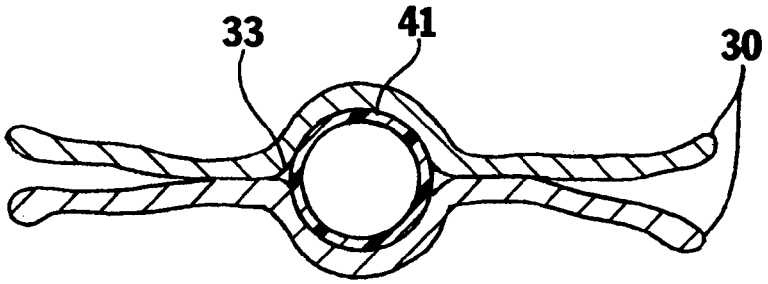
FIG. 5 is a cross sectional view, taken in the direction of line 5—5 in FIG. 2, illustrating the flat film valve wherein the tube is inserted therethrough.

Referring now to FIG. 2, an illumination device 40 is being inserted into the sleeve 33 through the mouth 14. The illumination device 40 comprises a tube 41 having a distal end 41D. The distal end 41D is sealed by means of heat sealing, by plugging, or by any other common sealing mechanism or method. As illustrated, the distal end 41D has been inserted through the mouth 14, and is now being passed through the sleeve 33. The tube 41 has a circumference which is substantially equal to twice the sleeve width 33W. Thus, referring to FIG. 5, as the tube 41 is inserted through the sleeve 33, the flat valve panels 30 spread apart just wide enough to allow the tube to pass through, thus leaving only minimal space between the tube and sleeve 33.

Figure 3:
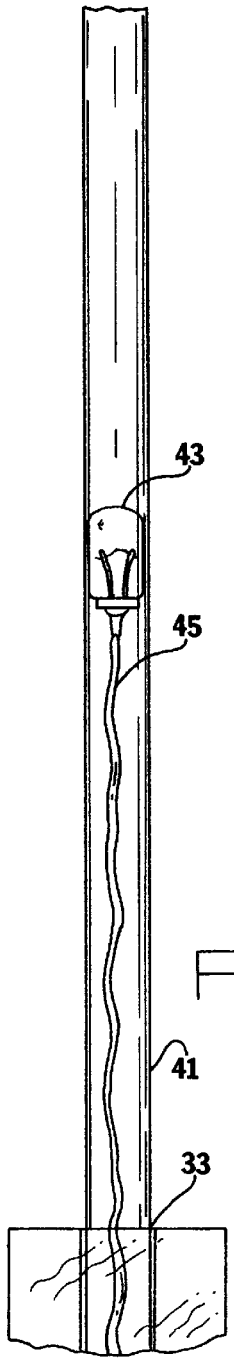
FIG. 3 is a front elevational view of the valve, wherein the tube has emerged from the flat film valve, and the valve has formed a tight seal therearound.

Referring to FIG. 3, the tube 41 has passed fully through the sleeve 33. A light source 43 is located within the tube 41, having an electrical cable 45 extending proximal therefrom. The electrical cable 45 generally consists of two conductors. The light source 43 is preferably an incandescent light bulb of a size that ranges between industry standard sizes of T 1 ¾ and T 1.

Referring once again to FIG. 1, when the tube 41 is fully inserted through the valve, the distal end 41D should reach the apex 15 of the balloon 10 and in fact "poke" at the apex 15 such that the balloon 10 is deformed slightly thereat. The distal end 41D rests firmly against the apex 15, holding the tube 41 in a stable position wherein it extends substantially vertically from the balloon bottom 10B to the balloon top 10T.

Also illustrated in FIG. 1, when the tube 41 is fully inserted through the valve, the light source 43 is centrally located between the apex 15 and valve 17. Thus, because the tube is held in a stable position, the light source 43 is effectively maintained in a central position within the balloon 10 where it evenly illuminates said balloon 10.

Also seen in FIG. 1 is a proximal end 41P of the tube, which is fully opposite the distal end 41D. the electrical cable 45 extends from the light source 43 proximally through the tube 41, and extends out the tube 41 at the proximal end 41P. The electrical cable 45 may serve the additional purpose of being a tether for the balloon, especially when the balloon is inflated with helium. The electrical cable 45 is preferably connected to a battery housing 47. The battery housing 47 contains an electrical power source. The battery housing 47 may incorporate a switching mechanism for selectively enabling the light source and disabling the light source. The switching mechanism may be momentary, wherein the light source is illuminated only when a user presses thereupon; may be timed, wherein the light source is illuminated for a fixed amount of time following activation; or may be settable, wherein the light source is illuminated after being activated until it is manually deactivated or the power source is exhausted.

Figure 6:
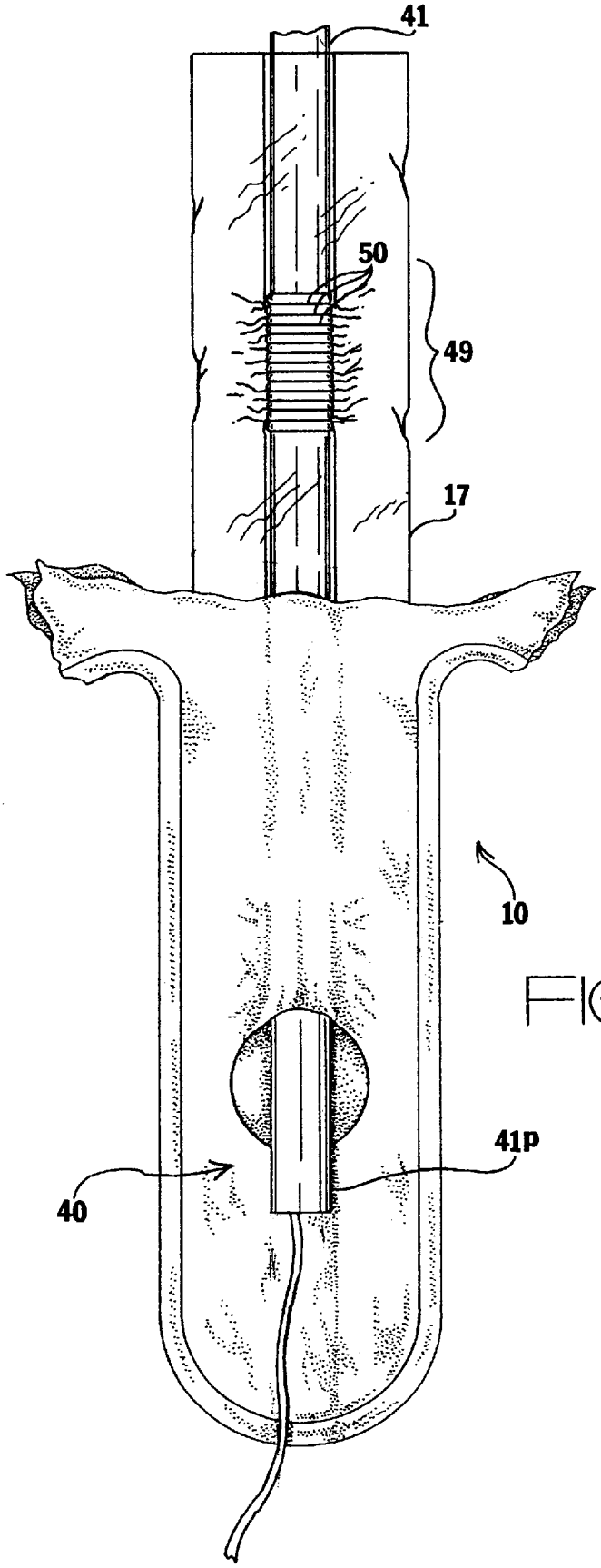
FIG. 6 is a front elevational view with parts broken away, illustrating a further embodiment of the invention, wherein the tube has an accordion portion, which has been inserted into the valve and has been compressed therein to form a tight seal therewith.

FIG. 6 illustrates a further embodiment of the illuminating device 40, wherein the tube 41 has an accordion portion 49 near the proximal end 41P. The accordion portion 49 is positioned on the tube 41 so that once the tube 41 is fully inserted in the balloon 10, the accordion portion 49 is located inside the valve 17. The accordion portion 49 is similar to the accordion-like flexible portion present in some drinking straws. The accordion portion comprises a plurality of transverse folds 50 which allow the accordion portion to be selectively expanded and contracted. As illustrated in FIG. 6, once the tube 41 is fully inserted into the balloon 10, the tube 41 is grasped both proximally and distally of the accordion portion 49, and the accordion portion 49 is manually compressed. Advantageously, as the accordion portion 49 is compressed, the flat film which comprises the sleeve 17 becomes pinched between the transverse folds 50. Thus, a multitude of seals are created within the valve, greatly enhancing the seal between the tube 41 and the sleeve and preventing gases from leaving from the balloon interior through the mouth 14.

In conclusion, herein is presented a balloon illumination system which allows a tube having a light source therein to be stabily mounted within a thin film balloon having a flat film valve, by inserting the tube through the flat film valve and resting the tube against the apex of the balloon. Electrical connectors extend through the tube for connection to a power source external to the balloon.

What is claimed is:

1. A balloon illumination system, for use with a thin film balloon having a pair of film panels sealed together to form a balloon interior, balloon top and a balloon bottom, a mouth near the balloon bottom, an apex at the balloon top, and a flat film valve defining a sleeve which provides gaseous communication between the mouth and the balloon interior, comprising:

a tube having a proximal end and a distal end, the tube sealed at the distal end, the tube sized to fit tightly within the sleeve yet allow said tube to pass therethrough, the tube having a length between its proximal and distal ends such that the tube extends substantially from the mouth to the apex when fully inserted into the balloon through the valve;

a light source located within the tube between the proximal end and distal end, the light source located substantially midway between the proximal end and distal end;

an electrical cable extending from the light source proximally through the tube, exiting said tube at the distal end thereof; and a power source, connected to the electrical cable for selectively illuminating the light source.

2. The balloon illumination system as recited in claim 1, the tube having a tube circumference, and wherein the valve further comprises two flat valve panels which are fused together along a pair of parallel fused strips to define the sleeve, the sleeve has a sleeve width which is defined as a distance between the fused strips, and wherein the tube circumference substantially equals two times said sleeve width.

3. The balloon illumination system as recited in claim 2, wherein the tube further has an accordion portion comprising a plurality of transverse folds, the accordion portion located on the tube so that when the tube is fully inserted into the balloon the accordion portion remains within the sleeve so that the accordion portion may be subsequently compressed to pinch the sleeve between the transverse folds to enhance sealing within the valve.

4. A balloon illumination method, for illuminating a thin film balloon having a pair of film panels sealed together to form a balloon interior, the balloon having a balloon top and a balloon bottom, a mouth near the balloon bottom, an apex at the balloon top, and a flat film valve defining a sleeve which provides gaseous communication between the mouth and the balloon interior, using a balloon illumination device comprising a tube having a proximal end and a distal end, the tube sealed at the distal end, the tube sized to fit tightly within the sleeve, a light source located in the tube between the proximal end and distal end, and an electrical cable extending proximally through the tube from the light source, comprising the steps of:

inserting the tube into sleeve by inserting the distal end into the mouth;

sliding the tube through the sleeve;

securing the tube within the balloon by resting the distal end at the apex; and illuminating the light source by supplying electrical power to the electrical cable.

5. The balloon illumination method as recited in claim 4, wherein the tube further has an accordion portion near the distal end thereof, the accordion portion having a plurality of transverse folds, wherein the step of sliding the tube through the sleeve further comprises sliding the accordion portion into the sleeve, and the step of securing the tube within the balloon further comprises:

grasping the tube proximally and distally of the accordion portion; and pinching the sleeve between the transverse folds by compressing the accordion portion.

* * * * *